US011200908B2

(12) United States Patent
Liu et al.

(10) Patent No.: US 11,200,908 B2
(45) Date of Patent: Dec. 14, 2021

(54) METHOD AND DEVICE FOR IMPROVING VOICE QUALITY

(71) Applicant: Fortemedia, Inc., Santa Clara, CA (US)

(72) Inventors: Qing-Guang Liu, Sunnyvale, CA (US); Xiaoyan Lu, San Jose, CA (US)

(73) Assignee: FORTEMEDIA, INC., Santa Clara, CA (US)

( * ) Notice: Subject to any disclaimer, the term of this patent is extended or adjusted under 35 U.S.C. 154(b) by 2 days.

(21) Appl. No.: 16/916,942

(22) Filed: Jun. 30, 2020

(65) Prior Publication Data

US 2021/0304779 A1 Sep. 30, 2021

Related U.S. Application Data

(60) Provisional application No. 63/000,535, filed on Mar. 27, 2020.

(51) Int. Cl.

| | |
|---|---|
| ***G10L 21/0208*** | (2013.01) |
| ***H04R 1/40*** | (2006.01) |
| ***H04R 3/00*** | (2006.01) |
| ***G10L 21/00*** | (2013.01) |

(52) U.S. Cl.

CPC ..... *G10L 21/0208* (2013.01)

(58) Field of Classification Search

CPC .. H04R 29/00; H04R 29/005; H04R 2430/23; H04R 1/406; H04R 1/40; H04R 3/00; H04R 3/005; H04R 25/407; H04R 25/00; G10L 21/0208; G10L 15/28; G10L 15/22; G10L 2021/02166; G10L 2021/0216; G10L 21/00; G10L 21/0232; G10L 15/20

USPC ..... 704/226, 227, 228, 231, 233, E15.039, 704/E15.041, E19.014, E21.002, E21.007, 704/E21.014, E21.015; 381/13, 16, 23, 381/23.1, 26, 56, 57, 61, 66, 313, 316, 381/320, 321, 71.1, 71.3, 71.6, 71.11, 381/71.12, 71.13, 71.14, 73.1, 74, 79, 86, 381/91, 92, 94.1, 94.2, 94.3, 94.5, 94.6, 381/94.9, 95, 97, 98, 99, 100, 101, 102, 381/103, 110, 111, 112, 113, 114, 115, 381/119, 122, 123; 455/596.2, 570; 379/406.01–406.16

See application file for complete search history.

(56) References Cited

U.S. PATENT DOCUMENTS

| | | | | |
|---|---|---|---|---|
| 9,363,596 | B2 | 6/2016 | Dusan et al. | |
| 2007/0058799 | A1* | 3/2007 | Sudo ..... | H04M 9/082 379/406.01 |
| 2012/0224715 | A1* | 9/2012 | Kikkeri ..... | H04R 3/005 381/92 |
| 2012/0259626 | A1* | 10/2012 | Li ..... | H04R 1/1083 704/226 |

(Continued)

*Primary Examiner* — Leshui Zhang

(74) *Attorney, Agent, or Firm* — McClure, Qualey & Rodack, LLP

(57) ABSTRACT

A method for improving voice quality is provided herein. The method includes receiving acoustic signals from a microphone array; receiving sensor signals from an accelerometer sensor of the headset; generating, by a beamformer, a speech output signal and a noise output signal according to the acoustic signals; best-estimating the speech output signal according to the sensor signals to generate a best-estimated signal; and generating a mixed signal according to the speech output signal and the best-estimated signal.

16 Claims, 4 Drawing Sheets

(56) References Cited

U.S. PATENT DOCUMENTS

| | | | | |
|---|---|---|---|---|
| 2014/0003611 | A1* | 1/2014 | Mohammad | H04B 3/20<br>381/66 |
| 2014/0270231 | A1* | 9/2014 | Dusan | H04R 1/46<br>381/74 |
| 2019/0272842 | A1* | 9/2019 | Bryan | H04R 3/005 |

* cited by examiner

METHOD AND DEVICE FOR IMPROVING VOICE QUALITY

CROSS REFERENCE TO RELATED APPLICATIONS

This application claims the benefit of U.S. Provisional Application No. 63/000,535, filed on Mar. 27, 2020, the entirety of which is incorporated by reference herein.

BACKGROUND OF THE INVENTION

Field of the Invention

The disclosure relates generally to methods and devices for setting machines, and more particularly it relates to methods and devices for setting and processing authentication self-help machines easily.

Description of the Related Art

Bone conduction sensors have been studied and utilized to improve the speech quality in communication devices due to their immunity to ambient noise in an acoustic noisy environment. These sensor signals or bone-conducted signals, however, can only represent speech signal well at low frequencies, unlike regular air-conducted microphones which capture sound with rich bandwidth either for speech signals or background noise. Therefore, combining of a sensor or bone-conducted signal and an air-conducted acoustic signal to enhance the speech quality is of great interest for communication devices used in a noisy environment.

BRIEF SUMMARY OF THE INVENTION

A method and a device for improving voice quality are provided herein. Signals from an accelerometer sensor and a microphone array are used for speech enhancement for wearable devices like earbuds, neckbands and glasses. All signals from the accelerometer sensor and the microphone array are processed in time-frequency domain for speech enhancement.

In an embodiment, a method for improving voice quality is provided herein. The method comprises receiving acoustic signals from a microphone array; receiving sensor signals from an accelerometer sensor; generating, by a beamformer, a speech output signal and a noise output signal according to the acoustic signals; best-estimating the speech output signal according to the sensor signals to generate a best-estimated signal; and generating a mixed signal according to the speech output signal and the best-estimated signal.

According to an embodiment of the invention, the method further comprises removing DC content of the acoustic signals from the microphone array and pre-emphasizing the acoustic signals to generate pre-emphasized acoustic signals; and performing short-term Fourier transform on the pre-emphasized acoustic signals to generate frequency-domain acoustic signals.

According to an embodiment of the invention, the step of generating, by the beamformer, the speech output signal and the noise output signal according to the acoustic signals comprises applying a spatial filter to the frequency-domain acoustic signals to generate the speech output signal and the noise output signal. The speech output signal is steered toward a first direction of a target speech and the noise output signal is steered toward a second direction. The second direction is opposite to the first direction.

According to an embodiment of the invention, the sensor signals comprise an X-axis signal, a Y-axis signal, and a Z-axis signal. The method further comprises removing DC content of the X-axis signal, the Y-axis signal, and the Z-axis signal from the accelerometer sensor and pre-emphasizing the X-axis signal, the Y-axis signal, and the Z-axis signal to generate a pre-emphasized X-axis signal, a pre-emphasized Y-axis signal, and a pre-emphasized Z-axis signal; and performing short-term Fourier transform on the pre-emphasized X-axis signal, the pre-emphasized Y-axis signal, and the pre-emphasized Z-axis signal to generate a frequency-domain X-axis signal, a frequency-domain Y-axis signal, and a frequency-domain Z-axis signal respectively.

According to an embodiment of the invention, the step of best-estimating the speech output signal by the sensor signals to generate a best-estimated signal further comprises applying an adaptive algorithm to the frequency-domain X-axis signal and the speech output signal to generate a first estimated signal; applying the adaptive algorithm to the frequency-domain Y-axis signal and the speech output signal to generate a second estimated signal; applying the adaptive algorithm to the frequency-domain Z-axis signal and the speech output signal to generate a third estimated signal; and selecting one with a maximal amplitude from the first estimated signal, the second estimated signal, and the third estimated signal to generate the best-estimated signal.

According to an embodiment of the invention, the adaptive algorithm is least mean square (LMS) algorithm, and a mean-square error between the frequency-domain X-axis signal and the speech output signal, a mean-square error between the frequency-domain Y-axis signal and the speech output signal, and a mean-square error between the frequency-domain Z-axis signal and the speech output signal are minimized.

According to another embodiment of the invention, the adaptive algorithm is least square (LS) algorithm, and a least-square error between the frequency-domain X-axis signal and the speech output signal, a least-square error between the frequency-domain Y-axis signal and the speech output signal, and a least-square error between the frequency-domain Z-axis signal and the speech output signal are minimized.

According to an embodiment of the invention, the accelerometer sensor has a maximum sensing frequency. The step of generating the mixed signal according to the speech output signal and the best-estimated signal further comprises when a first frequency range of the mixed signal does not exceed the maximum sensing frequency, selecting one with a minimal amplitude from the speech output signal and the best-estimated signal to represent the first frequency range of the mixed signal; and when a second frequency range of the mixed signal exceeds the maximum sensing frequency, selecting the speech output signal corresponding to the second frequency range to represent the second frequency range of the mixed signal.

According to an embodiment of the invention, the method further comprises after the mixed signal is generated, cancelling noise in the mixed signal with the noise output signal as a reference via an adaptive algorithm to generate a noise-cancelled mixed signal; suppressing noise in the noise-cancelled mixed signal with the noise output signal as a reference via a speech enhancement algorithm to generate a speech-enhanced signal; converting the speech-enhanced signal into time-domain to generate a time-domain speech-enhanced signal; and performing post-processing on the time-domain speech-enhanced signal to generate a speech signal.

According to an embodiment of the invention, the adaptive algorithm comprises least mean square (LMS) algorithm and least square (LS) algorithm. The speech enhancement algorithm comprises Spectral Subtraction, Wiener filter, and minimum mean square error (MMSE). The post-processing comprises de-emphasis, equalizer, and dynamic gain control.

In an embodiment, a device for improving voice quality comprises a microphone array, an accelerometer sensor, a beamformer, and a speech estimator. The accelerometer sensor has a maximum sensing frequency. The beamformer generates a speech output signal and a noise output signal according to acoustic signals from the microphone array. The speech estimator best-estimates the speech output signal according to sensor signals from the accelerometer sensor to generate a best-estimated signal and generates a mixed signal according to the speech output signal and the best-estimated signal.

According to an embodiment of the invention, the device further comprises a first pre-processor and a first STFT analyzer. The first pre-processor removes DC content of the acoustic signals and pre-emphasizes the acoustic signals to generate pre-emphasized acoustic signals. The first STFT analyzer performs short-term Fourier transform on the pre-emphasized acoustic signals to generate frequency-domain acoustic signals.

According to an embodiment of the invention, the beamformer applies a spatial filter to the frequency-domain acoustic signals to generate the speech output signal and the noise output signal. The speech output signal is steered toward a first direction of a target speech and the noise output signal is steered toward a second direction, wherein the second direction is opposite to the first direction.

According to an embodiment of the invention, the sensor signals comprise an X-axis signal, a Y-axis signal, and a Z-axis signal. The device further comprises a second pre-processor and a second STFT analyzer. The second pre-processor removes DC content of the X-axis signal, the Y-axis signal, and the Z-axis signal and pre-emphasizes the X-axis signal, the Y-axis signal, and the Z-axis signal to generate a pre-emphasized X-axis signal, a pre-emphasized Y-axis signal, and a pre-emphasized Z-axis signal. The second STFT analyzer performs short-term Fourier transform on the pre-emphasized X-axis signal, the pre-emphasized Y-axis signal, and the pre-emphasized Z-axis signal to generate a frequency-domain X-axis signal, a frequency-domain Y-axis signal, and a frequency-domain Z-axis signal respectively.

According to an embodiment of the invention, the speech estimator further comprises a first adaptive filter, a second adaptive filter, a third adaptive filter, and a first selector. The first adaptive filter applies an adaptive algorithm to the frequency-domain X-axis signal and the speech output signal to generate a first estimated signal. A difference of the first estimated signal and the speech output signal is minimized. The second adaptive filter applies the adaptive algorithm to the frequency-domain Y-axis signal and the speech output signal to generate a second estimated signal. A difference of the second estimated signal and the speech output signal is minimized. The third adaptive filter applies the adaptive algorithm to the frequency-domain Z-axis signal and the speech output signal to generate a third estimated signal. A difference of the third estimated signal and the speech output signal is minimized. The first selector selects one with a maximal amplitude from the first estimated signal, the second estimated signal, and the third estimated signal to generate the best-estimated signal.

According to an embodiment of the invention, the adaptive algorithm is least mean square (LMS) algorithm, and a mean-square error between the frequency-domain X-axis signal and the speech output signal, a mean-square error between the frequency-domain Y-axis signal and the speech output signal, and a mean-square error between the frequency-domain Z-axis signal and the speech output signal are minimized.

According to another embodiment of the invention, the adaptive algorithm is least square (LS) algorithm, and a least-square error between the frequency-domain X-axis signal and the speech output signal, a least-square error between the frequency-domain Y-axis signal and the speech output signal, and a least-square error between the frequency-domain Z-axis signal and the speech output signal are minimized.

According to an embodiment of the invention, the speech estimator further comprises a second selector. When a first frequency range of the mixed signal does not exceed the maximum sensing frequency, the second selector selects one with a minimal amplitude from the speech output signal and the best-estimated signal to represent the first frequency range of the mixed signal. When a second frequency range of the mixed signal exceeds the maximum sensing frequency, the second selector selects the speech output signal corresponding to the second frequency range to represent the second frequency range of the mixed signal.

According to an embodiment of the invention, the device further comprises a noise canceller, a noise suppressor, an STFT synthesizer, and a post-processor. The noise canceller cancels noise in the mixed signal with the noise output signal as a reference via an adaptive algorithm to generate a noise-cancelled mixed signal. The noise suppressor suppresses noise in the noise-cancelled mixed signal with the noise output signal as a reference via a speech enhancement algorithm to generate a speech-enhanced signal. The STFT synthesizer converts the speech-enhanced signal into time-domain to generate a time-domain speech-enhanced signal. The post-processor performs post-processing on the time-domain speech-enhanced signal to generate a speech signal.

According to an embodiment of the invention, the adaptive algorithm comprises least mean square (LMS) algorithm and least square (LS) algorithm. The speech enhancement algorithm comprises Spectral Subtraction, Wiener filter, and minimum mean square error (MMSE), wherein the post-processing comprises de-emphasis, equalizer, and dynamic gain control.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
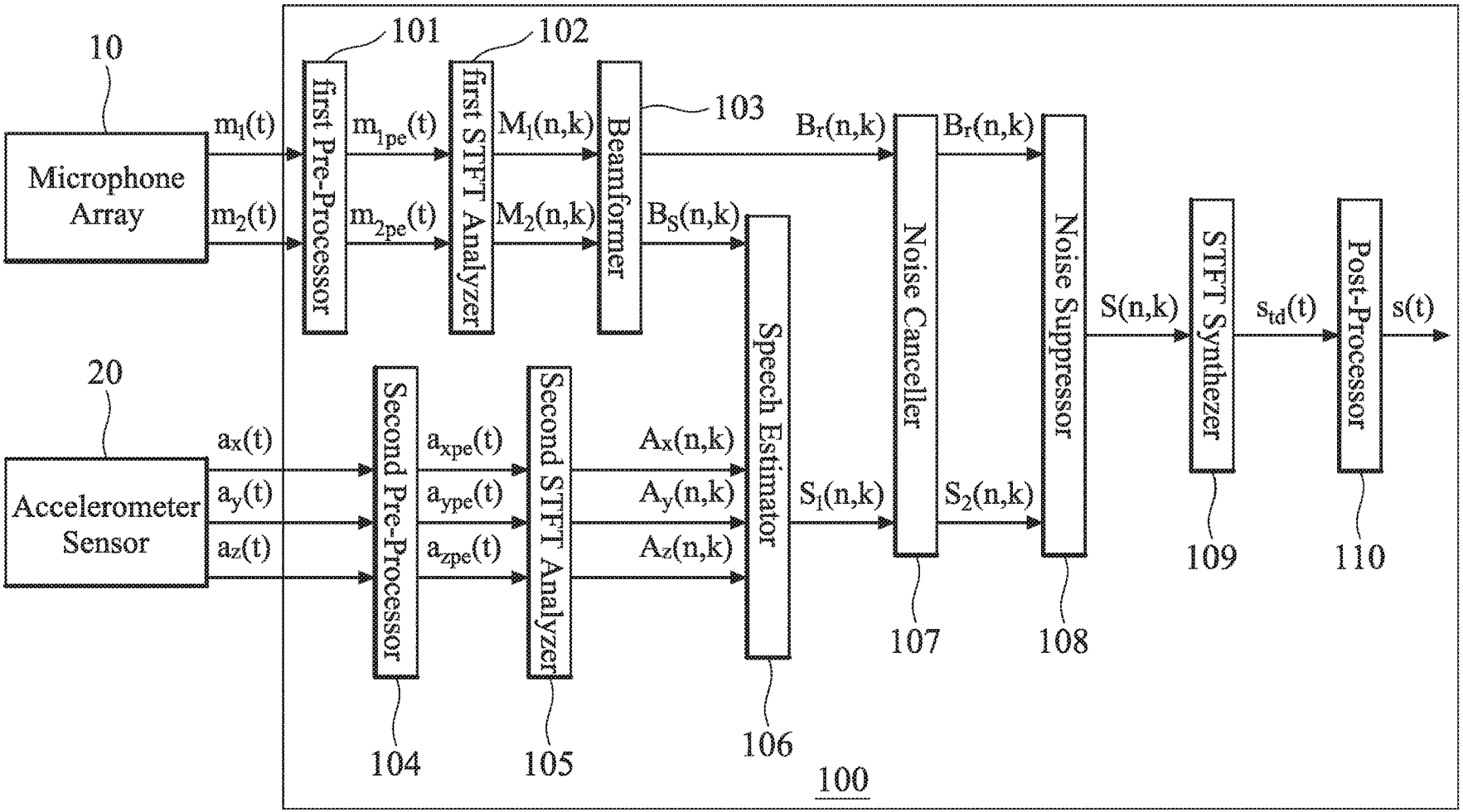
FIG. 1 is a block diagram of a device for improving voice quality in accordance with an embodiment of the invention.

This description is made for the purpose of illustrating the general principles of the invention and should not be taken in a limiting sense. In addition, the present disclosure may repeat reference numerals and/or letters in the various examples. This repetition is for the purpose of simplicity and clarity and does not in itself dictate a relationship between the various embodiments and/or configurations discussed. The scope of the invention is best determined by reference to the appended claims.

It will be understood that, in the description herein and throughout the claims that follow, although the terms "first," "second," etc. may be used to describe various elements, these elements should not be limited by these terms. These terms are only used to distinguish one element from another. For example, a first element could be termed a second element, and, similarly, a second element could be termed a first element, without departing from the scope of the embodiments.

It is understood that the following disclosure provides many different embodiments, or examples, for implementing different features of the application. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact.

FIG. 1 is a block diagram of a device for improving voice quality in accordance with an embodiment of the invention. According to an embodiment of the invention, the device 100 can be deployed in a wearable device such as an Earbud for voice communication or speech recognition. According to an embodiment of the invention, the device 100 is included in a pair of earbuds.

As shown in FIG. 1, the microphone array 10 detects a sound to generate acoustic signals, denoted by $m_1(t)$ and $m_2(t)$ at time instant t. According to some embodiments of the invention, the microphone array 10 may have two or more microphone units so that two or more acoustic signals are generated accordingly. In parallel, the accelerometer sensor 20 detects a vibration to generate 3-dimensional sensor signals, e.g., an X-axis sensor signal $a_x(t)$, a Y-axis sensor signal $a_y(t)$, and a Z-axis sensor signal $a_z(t)$.

The device 100, which receives the acoustic signals $m_1(t)$ and $m_2(t)$ and the X-axis sensor signal $a_x(t)$, the Y-axis sensor signal $a_y(t)$, and the Z-axis sensor signal $a_z(t)$, includes a first pre-processor 101, a first STFT analyzer 102, and a beamformer 103. The first pre-processor 101 removes the DC content of the acoustic signals $m_1(t)$ and $m_2(t)$ and pre-emphasizes the acoustic signals $m_1(t)$ and $m_2(t)$ from the microphone array 10 to generate pre-emphasized acoustic signals $m_{1pe}(t)$ and $m_{2pe}(t)$.

The first STFT analyzer 102 performs a short-term Fourier transform to split the pre-emphasized acoustic signals $m_{1pe}(t)$ and $m_{2pe}(t)$ in time domain into a plurality of frequency bins. According to an embodiment of the invention, the first STFT analyzer 102 performs the short-term Fourier transform by using overlap-add approach which performs DFT on one frame of signal with a time window overlapped with previous frame. After the STFT analyzer 102, frequency-domain acoustic signals $M_1(n, k)$ and $M_2(n, k)$, which are time-frequency representations of the two microphone signals, are obtained, where n represents a time index for one frame of data, k=1, . . . , K and K is total number of frequency bins split over the frequency bandwidth.

For each k, the beamformer 103 applies a spatial filter to the frequency-domain acoustic signals $M_1(n, k)$ and $M_2(n, k)$ to generate a speech output signal $B_s(n, k)$ and a noise output signal $B_r(n, k)$. The speech output signal $B_s(n, k)$ is steered in the direction of a target speech, and the noise output signal $B_r(n, k)$ is steered in the opposite direction of the target speech. In other words, the speech output signal $B_s(n, k)$ is speech weighted, and the noise output signal $B_r(n, k)$ is noise weighted.

The device 100 further includes a second pre-processor 104, a second STFT analyzer 105, and a speech estimator 106.

The second pre-processor 104 removes the DC content of the X-axis sensor signal $a_x(t)$, the Y-axis sensor signal $a_y(t)$, and the Z-axis sensor signal $a_z(t)$ and pre-emphasizes the X-axis sensor signal $a_x(t)$, the Y-axis sensor signal $a_y(t)$, and the Z-axis sensor signal $a_z(t)$ from the accelerometer sensor 20 to generate a pre-emphasized X-axis signal $a_{xpe}(t)$, a pre-emphasized Y-axis signal $a_{ype}(t)$, and a pre-emphasized Z-axis signal $a_{zpe}(t)$.

The second STFT analyzer 105 performs the short-term Fourier transform on the pre-emphasized X-axis signal $a_{xpe}(t)$, the pre-emphasized Y-axis signal $a_{ype}(t)$, and the pre-emphasized Z-axis signal $a_{zpe}(t)$ to generate a frequency-domain X-axis signal $A_x(n, k)$, a frequency-domain Y-axis signal $A_y(n, k)$, and a frequency-domain Z-axis signal $A_z(n, k)$ respectively, for each frequency bin of k at the time index of n.

The speech estimator 106 best-estimates the speech output signal $B_s(n, k)$ by using the frequency-domain X-axis signal $A_x(n, k)$, the frequency-domain Y-axis signal $A_y(n, k)$, and the frequency-domain Z-axis signal $A_z(n, k)$ to generate a best-estimated signal, and then generates a mixed signal $S_1(n, k)$ according to the speech output signal $B_s(n, k)$ and the best-estimated signal. How to generate the best-estimated signal and the mixed signal $S_1(n, k)$ will be explained in the following paragraphs.

Figure 2:
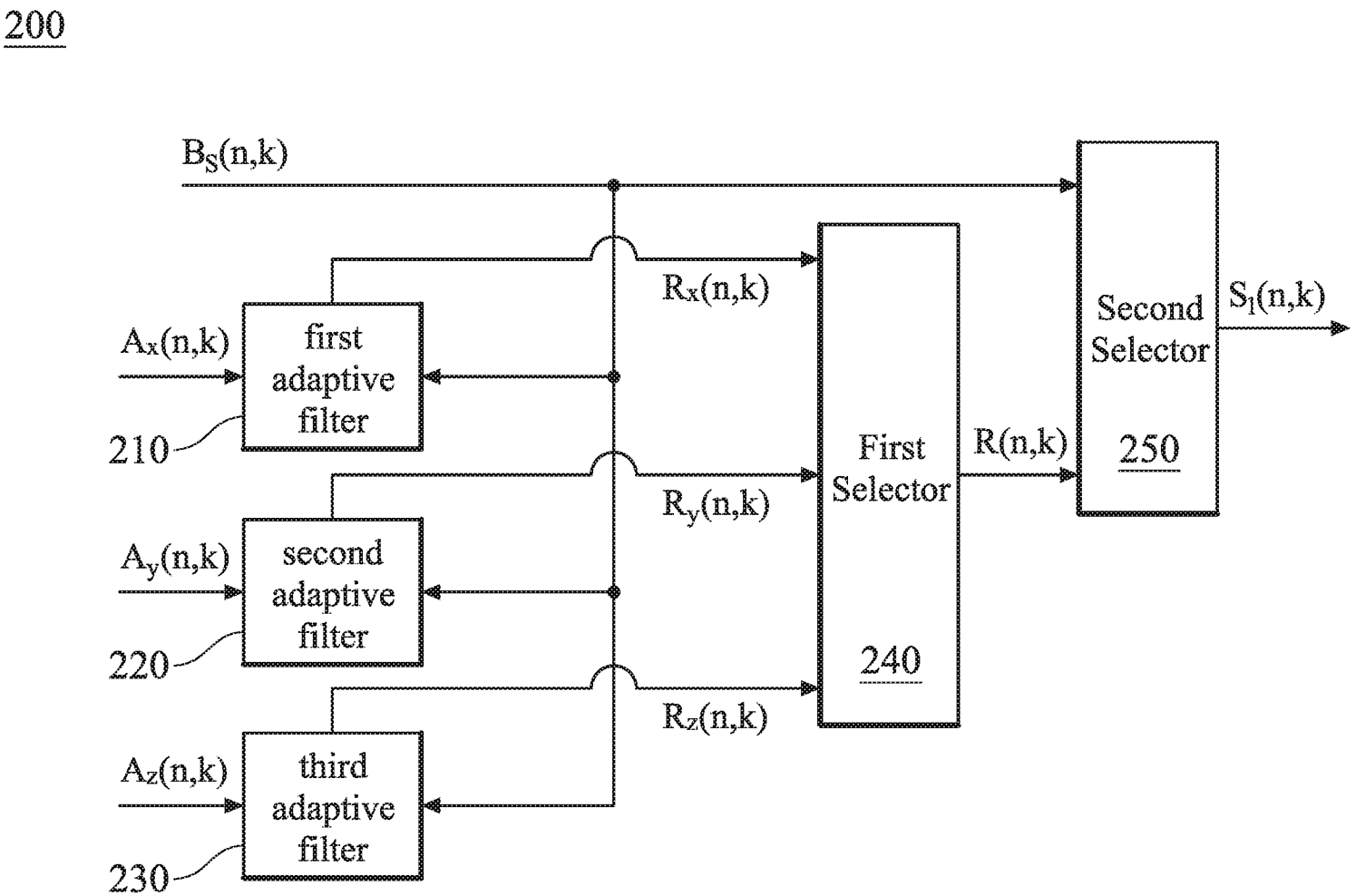
FIG. 2 is a block diagram of the speech estimator in accordance with an embodiment of the invention.

FIG. 2 is a block diagram of the speech estimator in accordance with an embodiment of the invention. According to an embodiment of the invention, the speech estimator 200 in FIG. 2 corresponds to the speech estimator 106 in FIG. 1.

As shown in FIG. 2, the speech estimator 200 includes a first adaptive filter 210, a second adaptive filter 220, a third adaptive filter 230, and a first selector 240. The first adaptive filter 210 applies an adaptive algorithm to the frequency-domain X-axis signal $A_x(n, k)$ and the speech output signal $B_s(n, k)$ to generate a first estimated signal $R_x(n, k)$ so that a difference of the first estimated signal $R_x(n, k)$ and the speech output signal $B_s(n, k)$ is minimized.

The first estimated signal $R_x(n, k)$ is expressed as Eq. 1, where $W_x(n, i)$, i=0, . . . , I−1, are the weights of FIR filter with order I, which will be updated at each time index n for all frequency bins k=1, . . . , K.

$$R_x(n,k)=\Sigma_{i=0}^{I-1}W_x(n,i)A_x(n-i,k) \quad \text{(Eq. 1)}$$

The second adaptive filter 220 applies the adaptive algorithm to the frequency-domain Y-axis signal $A_y(n, k)$ and the speech output signal $B_s(n, k)$ to generate a second estimated signal $R_y(n, k)$ so that a difference of the second estimated signal $R_y(n, k)$ and the speech output signal $B_s(n, k)$ is minimized.

The second estimated signal $R_y(n, k)$ is expressed as Eq. 2, where $W_y(n, i)$, i=0, . . . , I−1, are the weights of FIR filter with order I, which will be updated at each time index n for all frequency bins k=1, . . . , K.

$$R_y(n,k)\Sigma_{i=0}^{I-1}W_y(n,i)A_y(n-i,k) \quad \text{(Eq. 2)}$$

The third adaptive filter 230 applies the adaptive algorithm to the frequency-domain Z-axis signal $A_z(n, k)$ and the speech output signal $B_s(n, k)$ to generate a third estimated signal $R_z(n, k)$ so that a difference of the third estimated signal $R_z(n, k)$ and the speech output signal $B_s(n, k)$ is minimized.

The third estimated signal $R_z(n, k)$ is expressed as Eq. 3, where $W_z(n, i)$, i=0, . . . , I−1, are the weights of FIR filter with order I, which will be updated at each time index n for all frequency bins k=1, . . . , K.

$$R_z(n,k)=\Sigma_{i=0}^{I-1}W_z(n,i)A_z(n-i,k) \quad \text{(Eq. 3)}$$

According to an embodiment of the invention, the adaptive algorithm of the first adaptive filter 210, the second adaptive filter 220, and the third adaptive filter 230 may be least mean square (LMS) algorithm so that a mean-square error between the frequency-domain X-axis signal $R_x(n, k)$ and the speech output signal $B_s(n, k)$, a mean-square error between the frequency-domain Y-axis signal $R_y(n, k)$ and the speech output signal $B_s(n, k)$, and a mean-square error between the frequency-domain Z-axis signal $R_z(n, k)$ and the speech output signal $B_s(n, k)$ are minimized.

According to another embodiment of the invention, the adaptive algorithm of the first adaptive filter 210, the second adaptive filter 220, and the third adaptive filter 230 may be least square (LS) algorithm so that a least-square error between the frequency-domain X-axis signal $R_x(n, k)$ and the speech output signal $B_s(n, k)$, a least-square error between the frequency-domain Y-axis signal $R_y(n, k)$ and the speech output signal $B_s(n, k)$, and a least-square error between the frequency-domain Z-axis signal $R_z(n, k)$ and the speech output signal $B_s(n, k)$ are minimized.

The first selector 240 selects one with a maximal amplitude from the first estimated signal $R_x(n, k)$, the second estimated signal $R_y(n, k)$, and the third estimated signal $R_z(n, k)$ to generate the best-estimated signal R(n, k), which is expressed as Eq. 4.

$$R(n,k)=\text{Max}\{R_x(n,k),R_y(n,k),R_z(n,k)\} \quad \text{(Eq. 4)}$$

As shown in FIG. 2, the speech estimator 200 further includes a second selector 250. The second selector 250 generates the mixed signal $S_1(n, k)$ according to the best-estimated signal R(n, k) and the speech output signal $B_s(n, k)$. When a first frequency range of the mixed signal $S_1(n, k)$ does not exceed the maximum sensing frequency of the accelerometer sensor 20 in FIG. 1, the second selector 250 selects one with a minimal amplitude from the speech output signal $B_s(n, k)$ and the best-estimated signal R(n, k) to represent the first frequency range of the mixed signal $S_1(n, k)$.

According to an embodiment of the invention, the maximum sensing frequency of the accelerometer sensor 20 is the maximum frequency that the accelerometer sensor 20 is able to sense. When a second frequency range of the mixed signal $S_1$ (n, k) exceeds the maximum sensing frequency of the accelerometer sensor 20 in FIG. 1, the second selector 250 selects the speech output signal $B_s(n, k)$ corresponding to the second frequency range to represent the second frequency range of the mixed signal $S_1(n, k)$.

The mixed signal $S_1(n, k)$ is expressed as Eq. 5, where Min{ } stands for taking the element with the minimal amplitude, and Ks is a threshold of integer to be chosen in practice based on the maximum sensing frequency of the accelerometer being used.

$$S_1(n,k)=\begin{cases}\text{Min}\{B_s(n,k),\ R(n,k)\} & k\le K_s\\ B_s(n,k) & k>K_s\end{cases} \quad \text{(Eq. 5)}$$

In other words, one having the minimum amplitude from the best-estimated signal R(n, k) and the speech output signal $B_s(n, k)$ is selected to represent the mixed signal $S_1(n, k)$ when the frequency of the mixed signal $S_1(n, k)$ does not exceed the maximum sensing frequency of the accelerometer sensor 20; the speech output signal $B_s(n, k)$ is selected to represent the when the frequency of the mixed signal $S_1(n, k)$ exceeds the maximum sensing frequency of the accelerometer sensor 20.

According to an embodiment of the invention, when the frequency of the mixed signal $S_1$ (n, k) does not exceed the maximum sensing frequency of the accelerometer sensor 20, one having the minimum amplitude from the best-estimated signal R(n, k) and the speech output signal $B_s(n, k)$ is selected so that noise from the microphone array 10 can be reduced.

Referring to FIG. 1, the device 100 further includes a noise canceller 107, a noise suppressor 108, an STFT synthesizer 109, and a post-processor 110. After the speech estimator 106 in FIG. 1 generates the mixed signal $S_1(n, k)$, the noise canceller 107 cancels noise residing in the mixed signal $S_1$ (n, k) with the noise output signal $B_r$ (n, k) from the beamformer 103 as a reference via an adaptive algorithm to generate a noise-cancelled mixed signal $S_2$ (n, k). According to an embodiment of the invention, the adaptive algorithm includes least mean square (LMS) algorithm and least square (LS) algorithm.

The noise suppressor 108 suppresses noise in the noise-cancelled mixed signal $S_2$ (n, k) with the noise output signal $B_r(n, k)$ as a reference via a speech enhancement algorithm to generate a speech-enhanced signal S (n, k). According to some embodiments of the invention, the speech enhancement algorithm includes Spectral Subtraction, Wiener filter, and minimum mean square error (MMSE).

Figure 3:
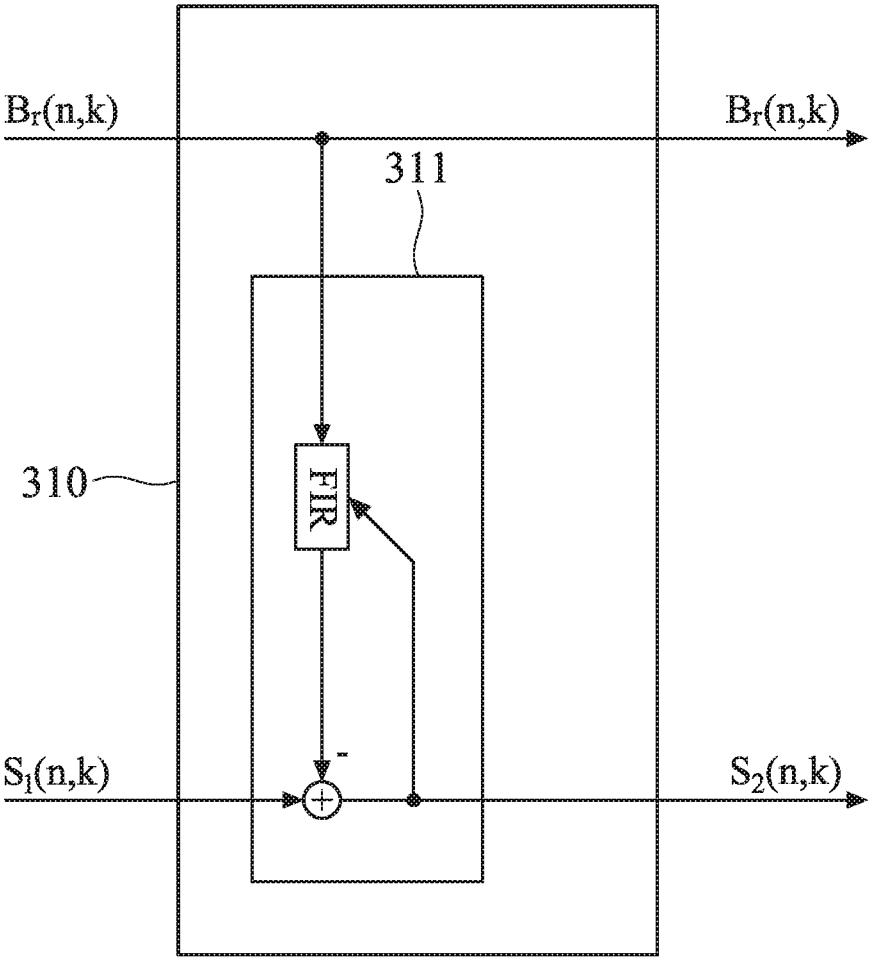
FIG. 3 is a block diagram of the noise canceller in accordance with an embodiment of the invention.

FIG. 3 is a block diagram of the noise canceller in accordance with an embodiment of the invention. As shown in FIG. 3, the noise canceller 310 corresponds to the noise canceller 107 in FIG. 1.

As shown in FIG. 3, the noise canceller 310 includes an adaptive filter 311 including an FIR filter FIR. The adaptive filter 311 cancels noise residing in the mixed signal $S_1(n, k)$ with the noise output signal $B_r(n, k)$ from the beamformer 103 as a reference to generate the noise-cancelled mixed signal $S_2(n, k)$. The noise-cancelled mixed signal $S_2$ (n, k) is expressed as Eq. 6, where U (n, j), j=0, . . . , J−1, are the weights of FIR filter FIR with order J, which are updated by an adaptive algorithm, such as LMS or LS.

$$S_2(n,k)=S_1(n,k)-\mu\Sigma_{j=0}^{J-1}U(n,j)B_r(n-j,k) \quad \text{(Eq. 6)}$$

According to an embodiment of the invention, the adaptation of the step-size p in the adaptive filter 311 may be controlled by voice activities in mixed signal $S_1$ (n, k). For examples, a smaller value is adopted when the mixed signal $S_1$ (n, k) contains mainly speech and a larger value is used when it contains mainly noise.

Referring to FIG. 1, the STFT synthesizer 109 converts the speech-enhanced signal S (n, k) generated by the noise suppressor 108 into time-domain to generate a time-domain speech-enhanced signal $s_{td}(t)$. The post-processor 110 performs post-processing on the time-domain speech-enhanced signal $s_{td}(t)$ to generate a speech signal s(t). According to some embodiments of the invention, the post-processing includes de-emphasis, equalizer and dynamic gain control. Therefore, the speech signal s(t) is obtained with enhanced speech to send to a far-end communication device.

Figure 4:
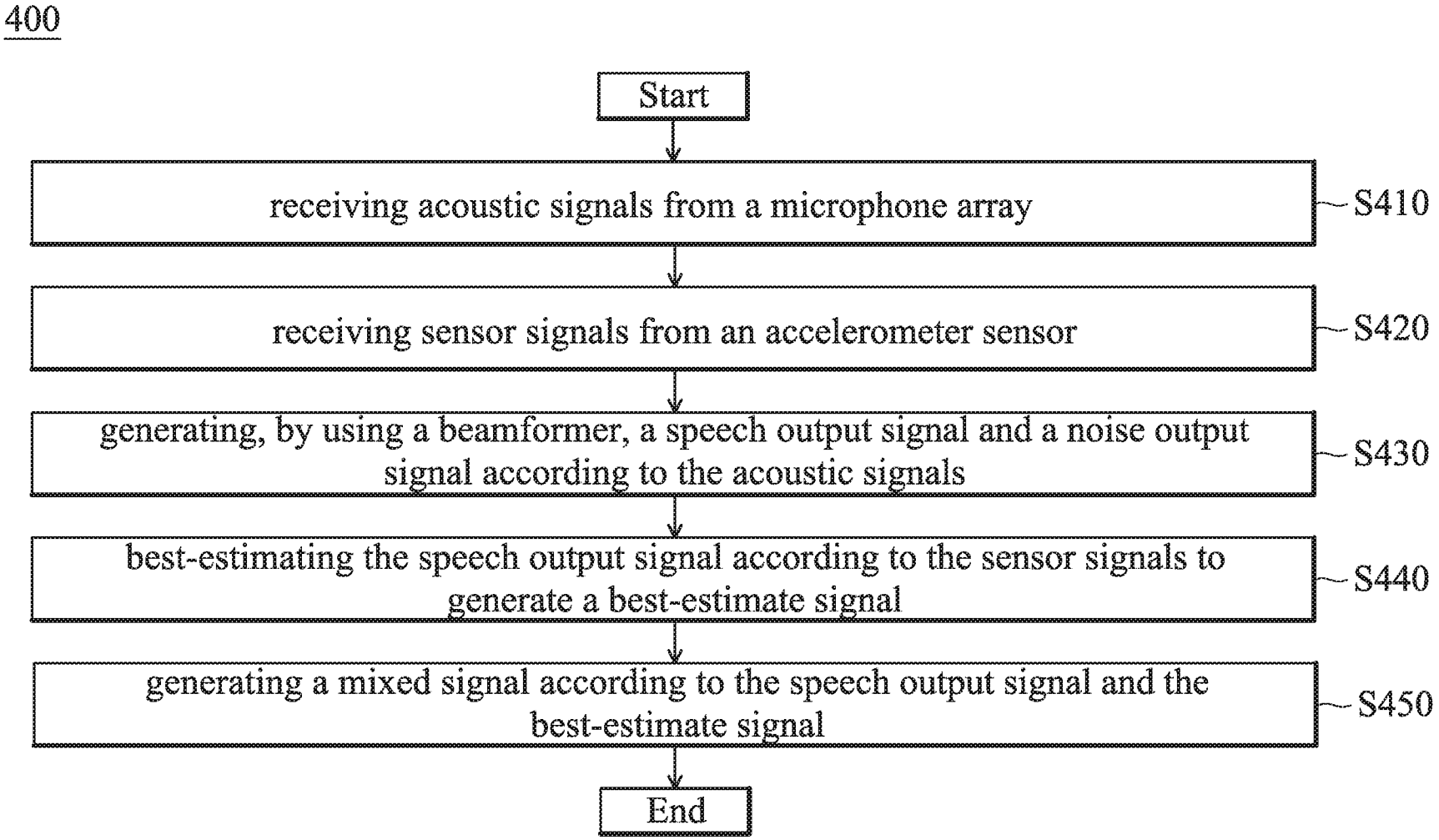
FIG. 4 is a flow chart of a method for improving voice quality in accordance with an embodiment of the invention.

FIG. 4 is a flow chart of a method for improving voice quality in accordance with an embodiment of the invention. In the following description of FIG. 4, FIGS. 1 and 2 will be accompanied for detailed explanation. As shown in FIG. 4, the method 400 starts with the device 100 receiving acoustic signals $m_1(t)$ and $m_2(t)$ from a microphone array 10 (Step S410). The device 100 also receives the sensor signals $a_x(t)$, $a_y(t)$, and $a_z(t)$ from the accelerometer sensor 20 (Step S420).

The beamformer 103 of the device 100 generates a speech output signal $B_s(n, k)$ and a noise output signal $B_r(n, k)$ according to the acoustic signals $m_1(t)$ and $m_2(t)$ (Step S430). The speech estimator 106 best-estimates the speech output signal $B_s(n, k)$ according to the sensor signals $a_x(t)$, $a_y(t)$, and $a_z(t)$ to generate a best-estimated signal R(n, k) (Step S440), and generates a mixed signal $S_1(n, k)$ according to the speech output signal $B_s(n, k)$ and the best-estimated signal R(n, k) (Step S450).

A method and a device for improving voice quality are provided herein. Signals from an accelerometer sensor and a microphone array are used for speech enhancement for wearable devices like earbuds, neckbands and glasses. All signals from the accelerometer sensor and the microphone array are processed in time-frequency domain for speech enhancement.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A method for improving voice quality, comprising:

receiving acoustic signals from a microphone array;

receiving sensor signals from an accelerometer sensor, wherein the sensor signals comprise an X-axis signal, a Y-axis signal, and a Z-axis signal;

removing DC content of the X-axis signal, the Y-axis signal, and the Z-axis signal from the accelerometer sensor and pre-emphasizing the X-axis signal, the Y-axis signal, and the Z-axis signal to generate a pre-emphasized X-axis signal, a pre-emphasized Y-axis signal, and a pre-emphasized Z-axis signal;

performing short-term Fourier transform on the pre-emphasized X-axis signal, the pre-emphasized Y-axis signal, and the pre-emphasized Z-axis signal to generate a frequency-domain X-axis signal, a frequency-domain Y-axis signal, and a frequency-domain Z-axis signal respectively;

generating, by a beamformer, a speech output signal and a noise output signal according to the acoustic signals;

best-estimating the speech output signal according to the sensor signals to generate a best-estimated signal, wherein the step of best-estimating the speech output signal by the sensor signals to generate a best-estimated signal further comprises:

applying an adaptive algorithm, using a first adaptive filter, to the frequency-domain X-axis signal and the speech output signal to generate a first estimated signal;

applying the adaptive algorithm, using a second adaptive filter, to the frequency-domain Y-axis signal and the speech output signal to generate a second estimated signal;

applying the adaptive algorithm, using a third adaptive filter, to the frequency-domain Z-axis signal and the speech output signal to generate a third estimated signal; and selecting one with a maximal amplitude from the first estimated signal, the second estimated signal, and the third estimated signal to generate the best-estimated signal; and generating a mixed signal according to the speech output signal and the best-estimated signal.

2. The method of claim 1, further comprising:

removing DC content of the acoustic signals from the microphone array and pre-emphasizing the acoustic signals to generate pre-emphasized acoustic signals; and performing short-term Fourier transform on the pre-emphasized acoustic signals to generate frequency-domain acoustic signals.

3. The method of claim 2, wherein the step of generating, by the beamformer, the speech output signal and the noise output signal according to the acoustic signals comprises:

applying a spatial filter to the frequency-domain acoustic signals to generate the speech output signal and the noise output signal, wherein the speech output signal is steered toward a first direction of a target speech and the noise output signal is steered toward a second direction, wherein the second direction is opposite to the first direction.

4. The method of claim 1, wherein the adaptive algorithm is a least mean square (LMS) algorithm, and a mean-square error between the frequency-domain X-axis signal and the speech output signal, a mean-square error between the frequency-domain Y-axis signal and the speech output signal, and a mean-square error between the frequency-domain Z-axis signal and the speech output signal are minimized.

5. The method of claim 1, wherein the adaptive algorithm is a least square (LS) algorithm, and a least-square error between the frequency-domain X-axis signal and the speech output signal, a least-square error between the frequency-domain Y-axis signal and the speech output signal, and a least-square error between the frequency-domain Z-axis signal and the speech output signal are minimized.

6. The method of claim 1, wherein the accelerometer sensor has a maximum sensing frequency, wherein the step of generating the mixed signal according to the speech output signal and the best-estimated signal further comprises:

when a first frequency range of the mixed signal does not exceed the maximum sensing frequency, selecting one with a minimal amplitude from the speech output signal and the best-estimated signal to represent the first frequency range of the mixed signal; and when a second frequency range of the mixed signal exceeds the maximum sensing frequency, selecting the speech output signal corresponding to the second frequency range to represent the second frequency range of the mixed signal.

7. The method of claim 1, further comprising:

after the mixed signal is generated, cancelling noise in the mixed signal with the noise output signal as a reference via an adaptive algorithm to generate a noise-cancelled mixed signal;

suppressing noise in the noise-cancelled mixed signal with the noise output signal as a reference via a speech enhancement algorithm to generate a speech-enhanced signal;

converting the speech-enhanced signal into time-domain to generate a time-domain speech-enhanced signal; and performing post-processing on the time-domain speech-enhanced signal to generate a speech signal.

8. The method of claim 7, wherein the adaptive algorithm comprises least mean square (LMS) algorithm and least square (LS) algorithm, wherein the speech enhancement algorithm comprises Spectral Subtraction, Wiener filter, and minimum mean square error (MMSE), wherein the post-processing comprises de-emphasis, equalizer, and dynamic gain control.

9. A device for improving voice quality, comprising:

a microphone array;

an accelerometer sensor, having a maximum sensing frequency;

a beamformer, generating a speech output signal and a noise output signal according to acoustic signals from the microphone array;

a speech estimator, best-estimating the speech output signal according to sensor signals from the accelerometer sensor to generate a best-estimated signal and generating a mixed signal according to the speech output signal and the best-estimated signal, wherein the sensor signals comprise an X-axis signal, a Y-axis signal, and a Z-axis signal;

a second pre-processor, removing DC content of the X-axis signal, the Y-axis signal, and the Z-axis signal and pre-emphasizing the X-axis signal, the Y-axis signal, and the Z-axis signal to generate a pre-emphasized X-axis signal, a pre-emphasized Y-axis signal, and a pre-emphasized Z-axis signal; and a second STFT analyzer, performing short-term Fourier transform on the pre-emphasized X-axis signal, the pre-emphasized Y-axis signal, and the pre-emphasized Z-axis signal to generate a frequency-domain X-axis signal, a frequency-domain Y-axis signal, and a frequency-domain Z-axis signal respectively;

wherein the speech estimator further comprises:

a first adaptive filter, applying an adaptive algorithm to the frequency-domain X-axis signal and the speech output signal to generate a first estimated signal, wherein a difference of the first estimated signal and the speech output signal is minimized;

a second adaptive filter, applying the adaptive algorithm to the frequency-domain Y-axis signal and the speech output signal to generate a second estimated signal, wherein a difference of the second estimated signal and the speech output signal is minimized;

a third adaptive filter, applying the adaptive algorithm to the frequency-domain Z-axis signal and the speech output signal to generate a third estimated signal, wherein a difference of the third estimated signal and the speech output signal is minimized; and a first selector, selecting one with a maximal amplitude from the first estimated signal, the second estimated signal, and the third estimated signal to generate the best-estimated signal.

10. The device of claim 9, further comprising:

a first pre-processor, removing DC content of the acoustic signals and pre-emphasizing the acoustic signals to generate pre-emphasized acoustic signals; and a first STFT analyzer, performing short-term Fourier transform on the pre-emphasized acoustic signals to generate frequency-domain acoustic signals.

11. The device of claim 9, wherein the beamformer applies a spatial filter to the frequency-domain acoustic signals to generate the speech output signal and the noise output signal, wherein the speech output signal is steered toward a first direction of a target speech and the noise output signal is steered toward a second direction, wherein the second direction is opposite to the first direction.

12. The device of claim 9, wherein the adaptive algorithm is a least mean square (LMS) algorithm, and a mean-square error between the frequency-domain X-axis signal and the speech output signal, a mean-square error between the frequency-domain Y-axis signal and the speech output signal, and a mean-square error between the frequency-domain Z-axis signal and the speech output signal are minimized.

13. The device of claim 9, wherein the adaptive algorithm is a least square (LS) algorithm, and a least-square error between the frequency-domain X-axis signal and the speech output signal, a least-square error between the frequency-domain Y-axis signal and the speech output signal, and a least-square error between the frequency-domain Z-axis signal and the speech output signal are minimized.

14. The device of claim 9, wherein the speech estimator further comprises:

a second selector, wherein when a first frequency range of the mixed signal does not exceed the maximum sensing frequency, the second selector selects one with a minimal amplitude from the speech output signal and the best-estimated signal to represent the first frequency range of the mixed signal, wherein when a second frequency range of the mixed signal exceeds the maximum sensing frequency, the second selector selects the speech output signal corresponding to the second frequency range to represent the second frequency range of the mixed signal.

15. The device of claim 9, further comprising:

a noise canceller, cancelling noise in the mixed signal with the noise output signal as a reference via an adaptive algorithm to generate a noise-cancelled mixed signal;

a noise suppressor, suppressing noise in the noise-cancelled mixed signal with the noise output signal as a reference via a speech enhancement algorithm to generate a speech-enhanced signal;

an STFT synthesizer, converting the speech-enhanced signal into time-domain to generate a time-domain speech-enhanced signal; and a post-processor, performing post-processing on the time-domain speech-enhanced signal to generate a speech signal.

16. The device of claim 15, wherein the adaptive algorithm comprises least mean square (LMS) algorithm and least square (LS) algorithm, wherein the speech enhancement algorithm comprises Spectral Subtraction, Wiener filter, and minimum mean square error (MMSE), wherein the post-processing comprises de-emphasis, equalizer, and dynamic gain control.

* * * * *